US006145483A

United States Patent [19]

Asai

[11] Patent Number: 6,145,483

[45] Date of Patent: Nov. 14, 2000

[54] TWO-CYCLE INTERNAL COMBUSTION ENGINE

[75] Inventor: Masahiro Asai, Wako, Japan

[73] Assignee: Honda Giken Kogyo Kabushiki Kaisha, Tokyo, Japan

[21] Appl. No.: 09/083,087

[22] Filed: May 22, 1998

[30] Foreign Application Priority Data

May 24, 1997 [JP] Japan ..... 9-150375

[51] Int. Cl.[7] ..... F02B 33/04

[52] U.S. Cl. ..... 123/73 C; 123/65 V; 123/193.6

[58] Field of Search ..... 123/73 C, 73 B, 123/73 E, 73 V, 65 V, 532, 65 PE, 193.6

[56] References Cited

U.S. PATENT DOCUMENTS

| | | | |
|---|---|---|---|
| 880,958 | 3/1908 | Bachle et al. | 123/65 V |
| 1,149,296 | 8/1915 | Scott et al. | 123/73 C |
| 1,181,634 | 5/1916 | Bivert | 123/73 B |
| 1,743,558 | 1/1930 | McCabe | 123/65 V |
| 1,839,576 | 1/1932 | Mohr et al. | 123/65 PE |
| 1,952,275 | 3/1934 | Mohr | 123/65 PE |
| 2,242,538 | 5/1941 | Naccache | 123/73 V |
| 4,969,425 | 11/1990 | Slee | 123/73 AA |
| 5,271,358 | 12/1993 | Katoh et al. . | |
| 5,575,246 | 11/1996 | Ito | 123/65 PE |
| 5,857,449 | 1/1999 | Ishikawa et al. | 123/557 |
| 5,950,581 | 9/1999 | Nishida et al. | 123/73 C |

FOREIGN PATENT DOCUMENTS

| | | |
|---|---|---|
| 0764774 A2 | 3/1997 | European Pat. Off. . |
| 50-60617 | 5/1975 | Japan . |
| 9-144545 | 6/1997 | Japan . |

*Primary Examiner*—Noah P. Kamen
*Attorney, Agent, or Firm*—Birch, Stewart, Kolasch & Birch, LLP

[57] ABSTRACT

A two-cycle internal combustion engine includes a control valve disposed in a communicating passage for communicating the combustion chamber to a chamber portion adjacent to the combustion chamber. The control valve controls the opening and closing of the communicating passage. A fuel or an air-fuel mixture is supplied into the combustion chamber through the communicating passage. The fuel injection opening of the communicating passage has a height which is smaller than the distance between outermost side surfaces of the piston rings to reduce the amount of the air-fuel mixture or combustion gas leaking from the combustion chamber into the crank chamber through gaps between the piston and the opening. Therefore, reduction in engine output or seizure of the piston due to local temperature rise is avoided.

19 Claims, 5 Drawing Sheets

TWO-CYCLE INTERNAL COMBUSTION ENGINE

BACKGROUND OF THE INVENTION

1. Field of the Invention

The present invention relates to a two-cycle internal combustion engine. A control valve is disposed in a communicating passage for communicating a combustion chamber with a chamber portion adjacent to the combustion chamber and for controlling the opening and closing of the communicating passage. A fuel or an air-fuel mixture is supplied into the combustion chamber through the communicating passage. In particular, the present invention relates to a two-cycle internal combustion engine having openings, such as fuel injection openings formed in a side wall of the cylinder at a position facing to the combustion chamber, configured to reduce the amount of air-fuel mixture or combustion gas that leaks from the combustion chamber into the crank chamber through gaps between the piston and the openings. This configuration of the combustion chamber avoids problems such as reduction in engine output or seizure of the piston due to local temperature rise.

2. Description of Background Art

Two-cycle internal combustion engines having scavenging is known. Air pre-compressed in a crank chamber and a rich air-fuel mixture formed in a chamber portion adjacent to a side of a combustion chamber is directly injected into the combustion chamber from a rich air-fuel mixture injection opening. A rich air-fuel mixture injection control valve disposed in a communicating passage for communicating the chamber portion to the combustion chamber is opened to inject the rich air-fuel mixture (see Japanese Patent Laid-open Nos. Sho 50-60617 and Hei 8-269366).

In this known engine, since scavenging is performed only by air containing no fuel pre-compressed in the crank chamber, blowby of an air-fuel mixture can be significantly reduced, resulting in a reduction of fuel consumption and an improvement in exhaust gas purifying performance. However, this known engine has a problem. As shown in FIG. 5, an opening height Ha of an opening 022 through which a rich air-fuel mixture is injected into a cylinder bore 05 is larger than a distance Hb between outermost side surfaces A and B in the direction of the cylinder axis, of a plurality of piston rings 029*a* and 029*b*. Accordingly, when these piston rings 029*a* and 029*b* pass through the opening 022, the air-fuel mixture and the combustion gas in the combustion chamber 013 leak into the crank chamber through a gap formed between the piston 06 and the opening 022. As a result, there is a reduction in engine output and possible seizure of the piston 06 due to local temperature rise.

Furthermore, the same problems occur when the opening height Ha of a highly compressed gas intake opening 027, opening into the combustion chamber 013, for allowing air in the combustion chamber 013 at a high pressure to transfer into a chamber portion 020 for forming a rich air-fuel mixture, is larger than the distance Hb between the outermost side surfaces A and B of the plurality of piston rings 29*a* and 29*b* in the direction of the cylinder axis.

In addition, reference numeral 04 indicates a cylinder head; 021 and 028 are communicating passages; 024 is a rich air-fuel mixture injection control valve (rotary valve); and 026 is a fuel injection device.

SUMMARY AND OBJECTS OF THE INVENTION

The present invention is intended to improve the shape of openings in a two-cycle internal combustion engine in order to solve the above-described problems. According to a first embodiment of the present invention, a two-cycle internal combustion engine has a control valve disposed in a communicating passage between a combustion chamber and a chamber portion adjacent to the combustion chamber. The control valve is for controlling the opening and closing of the communicating passage. Furthermore, fuel or an air-fuel mixture is supplied into the combustion chamber through the communicating passage and a height of a fuel/air-fuel mixture injection opening facing the combustion chamber is smaller than a distance between outermost side surfaces of a plurality of piston rings mounted in a piston.

In the first embodiment, when the plurality of the piston rings pass through the fuel injection opening portion, at least one of the piston rings closes a gap between the piston and an inner wall surface of the cylinder. As a result, even when a gap in communication with the combustion chamber or the crank chamber is formed between the piston and the fuel injection opening, it is possible to prevent an air-fuel mixture and combustion gas from leaking into the crank chamber through the gap. Therefore, reduction in engine output and seizure of the piston due to local temperature rise is avoided.

According to a second embodiment of the present invention, a two-cycle internal combustion engine has a control valve disposed in a communicating passage between a combustion chamber and a chamber portion adjacent to the combustion chamber. The control valve is for controlling the opening and closing of the communicating passage. Fuel or an air-fuel mixture is supplied into the combustion chamber through the communicating passage and an opening through which a highly compressed gas in the combustion chamber is transferred into the chamber portion is formed in a cylinder side wall at a position facing the combustion chamber. Furthermore, the height of the opening is smaller than a distance between outermost side surfaces of a plurality of piston rings mounted in a piston.

In the second embodiment, when the plurality of the piston rings pass through the highly compressed gas intake opening portion, at least one of the piston rings closes the gap between the piston and an inner wall surface of the cylinder. As a result, even when a gap communicating with the combustion chamber or the crank chamber is formed between the piston and the air intake opening, it is possible to prevent an air-fuel mixture and combustion gas from leaking into the crank chamber through the gap. Therefore, reduction in engine output and seizure of the piston due to local temperature rise is avoided. Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
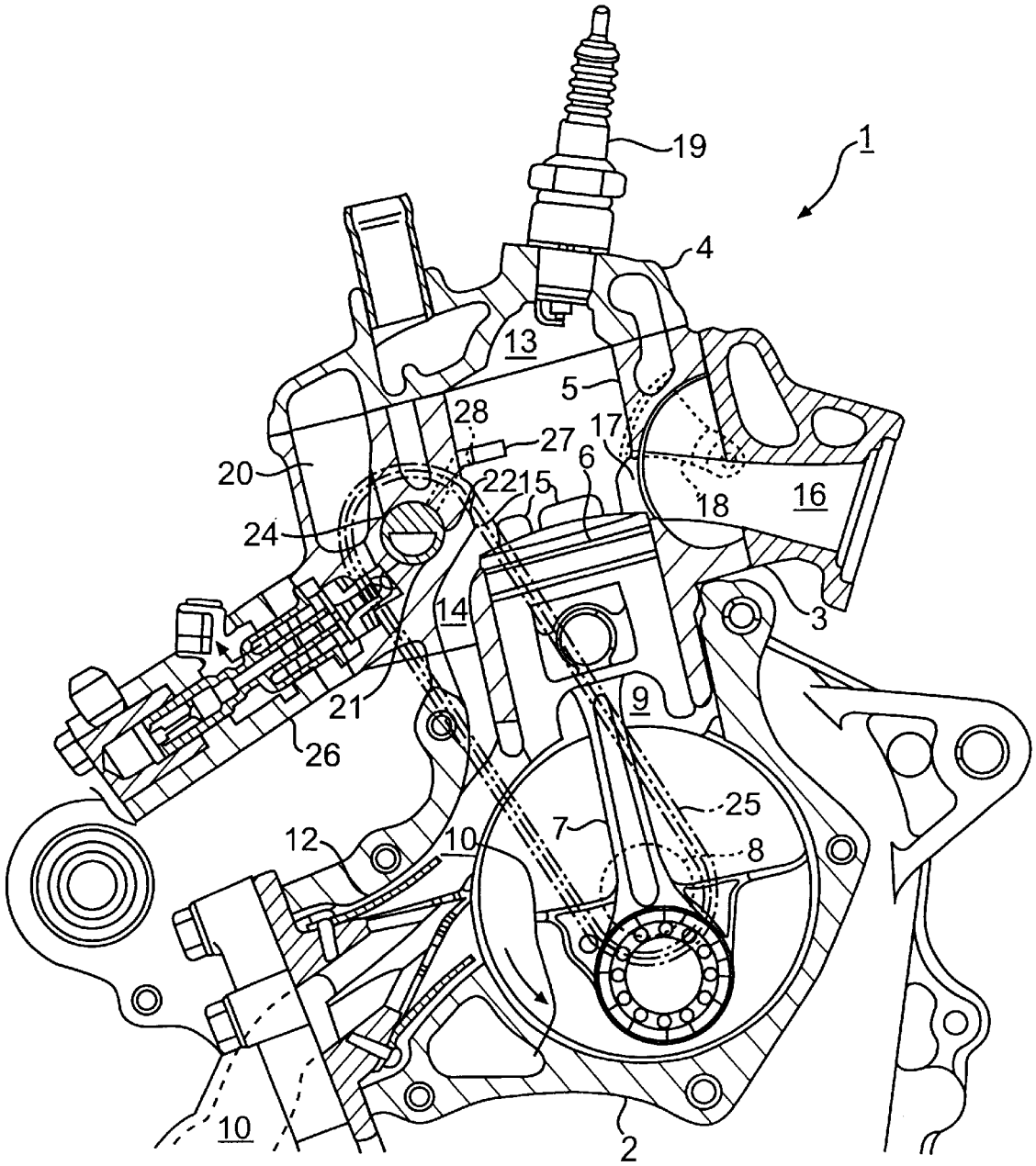
FIG. 1 is a schematic vertical sectional view of a two-cycle internal combustion engine according to a first embodiment of the present invention.

Hereinafter, a first embodiment of the present invention will be first described with reference to FIGS. 1 to 3.

A spark ignition type two-cycle internal combustion engine 1 in this embodiment is to be mounted on a motorcycle (not shown). In this engine 1, a cylinder block 3 and a cylinder head 4 are sequentially superimposed on the crank case 2 and integrated to each other.

A piston 6 is vertically slidably inserted in a cylinder bore 5 formed in the cylinder block 3. The piston 6 is connected to a crank shaft 8 by means of a connecting rod 7, so that the crank shaft 8 is rotated by vertical movement of the piston 6.

An intake passage 10 extending forward from a rear side of a vehicular body is connected to an intake passage 10 in the crank case 2. A throttle valve (not shown) and a reed valve 12 are interposed in series in the intake passage 10. The throttle valve is connected to a throttle grip (not shown) through a connecting means (not shown) such that degree of opening of the throttle valve is increased when the throttle grip is twisted in one direction.

Air supply scavenging passages are formed in the crank case 2. There are a total of five passages in the crank case 2; four passages (two on each of right and left sides) for communicating an upper portion of the cylinder bore 5 to the crank case 9; and a rear side air supply scavenging passage (which will be described later) opened under both an air-fuel mixture (fuel) supply opening 22 and a highly compressed gas intake opening 27. Ends of these scavenging passages on the cylinder bore 5 side form openings 15 opened to the cylinder bore 5. The air supply scavenging passage 14 is directly connected to the intake passage 10 in the crank case 2 on the downstream side of the reed valve 12 (see FIG. 1).

An exhaust passage 16 includes an exhaust opening 17 on the cylinder bore side which extends higher than the openings 15 of these air supply scavenging passages 14 and is disposed at a position opposed to the rich air-fuel mixture (fuel) supply opening 22 described later. Reference numeral 18 indicates an exhaust control valve, provided near the exhaust opening 17 of the exhaust passage 16, for changing a height of an upper edge of the exhaust opening 17 so as to vary the exhaust timing and to vary a cross-section of the exhaust passage 16.

A combustion chamber 13 formed in an approximately semi-spherical shape is disposed over the cylinder bore 5 and is offset toward the exhaust opening 17. An ignition or spark plug 19 is connected to the cylinder head 4 and communicates with the combustion chamber 13.

A chamber portion 20 is provided in the cylinder block 3 adjacent to a side of the combustion chamber 13, offset toward the rear side of the body. A valve containing hole 23 is disposed in a communicating passage halfway between the chamber portion 20 and combustion chamber 13. A rich air/fuel mixture injection control valve 24 composed of a rotary valve is rotatably inserted in the valve containing hole 23. The rich air-fuel mixture injection control valve 24 is rotated at the same rotational speed as that of the crank shaft 8 in the direction reverse to the rotational direction of the crank shaft 8 (counterclockwise in FIG. 1) by a transmission mechanism 25.

A fuel injection device 26 has an injection port facing a portion 21*b* of the communicating passage 21, located on the upstream side of where the rotary valve 24 is disposed.

A highly compressed gas for forming a rich air-fuel mixture is supplied into the chamber portion 20 from the highly compressed gas intake opening 27 formed in a side wall of the cylinder at a position facing the combustion chamber 13.

The highly compressed gas is supplied into the chamber portion 20 through a communicating passage 28 between the chamber portion 20 and the highly compressed gas intake opening 27 while being controlled by a rotary valve axially integrated with the rich air-fuel mixture injection control valve 24.

The highly compressed gas supplied into the chamber portion 20 flows into the communicating passage 21*b* when the rich air-fuel mixture injection control valve 24 is opened. The highly compressed gas is mixed with fuel injected from the fuel injection device 26 in a mixing chamber 21*c* formed in the communicating passage 21*b*, to form a rich air-fuel mixture. The rich air-fuel mixture thus formed is press-fed by high pressure in the chamber portion 20 and is injected from the rich air-fuel injection opening 22 into the combustion chamber 13.

Figure 2:
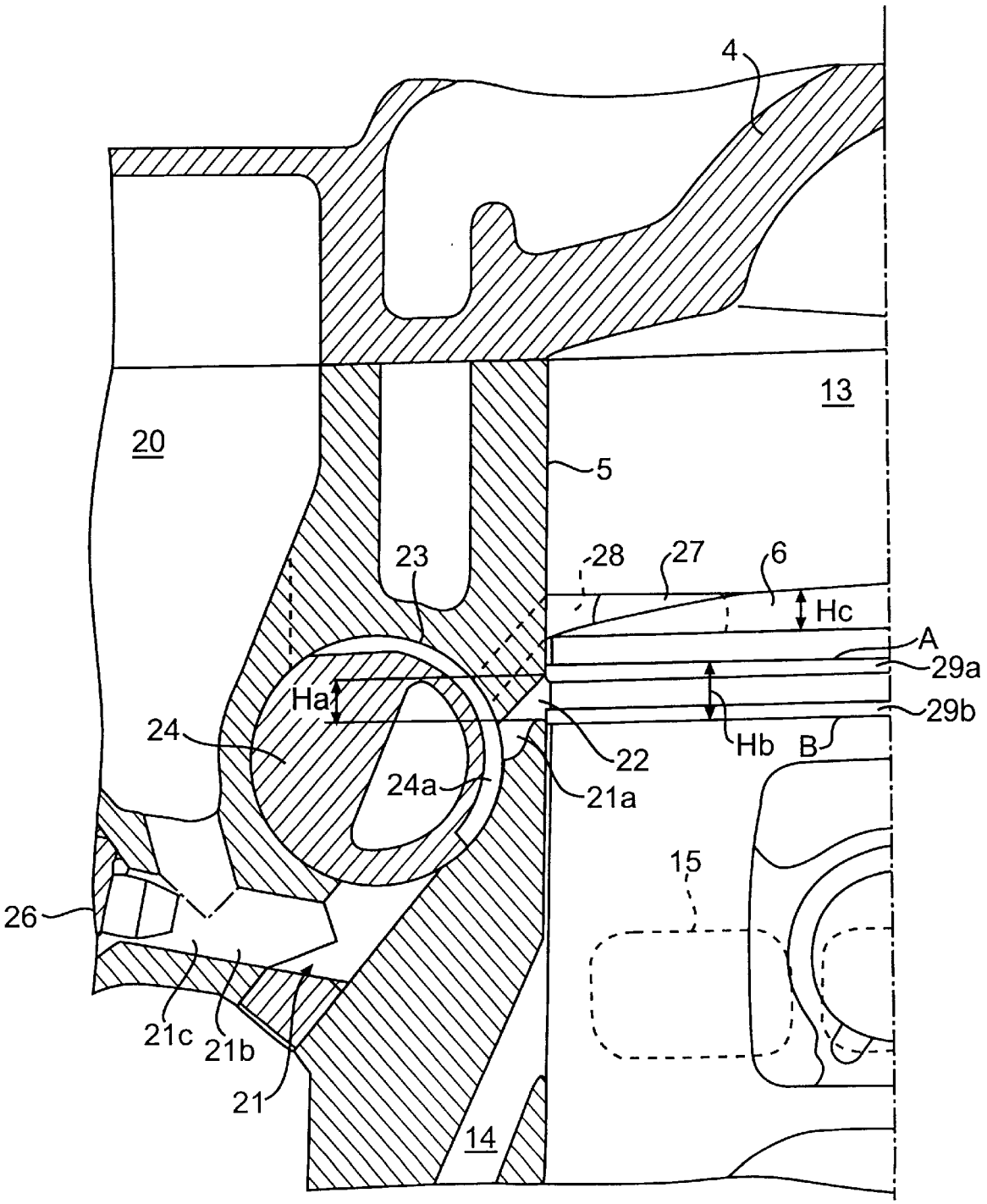
FIG. 2 is a vertical sectional view of an essential portion of FIG. 1.

Referring to FIG. 2, the height Ha of the rich air-fuel mixture injection opening 22 and a height Hc of the highly compressed gas intake opening 27, for sucking a highly compressed gas for forming a rich air-fuel mixture, is smaller than a distance Hb between outermost side surfaces A and B of two piston rings 29*a* and 29*b* mounted in the piston.

The spark ignition type two-cycle internal combustion engine according to the first embodiment of the present invention operates as follows: When the crank shaft 8 is rotated counterclockwise in FIG. 1 by a starter motor (not shown), the exhaust opening 17 is blocked by the piston 6 at the 90° before top dead center (TDC) position (compression stroke), as shown in FIG. 3. At this time, the rotary valve integrated with the rich air-fuel mixture injection control valve 24 is opened, and a highly compressed gas in the combustion chamber 13 flows into the chamber portion 20 through the highly compressed gas intake opening 27 and the communication passage 28.

When the piston is at the 75° before the top dead center (TDC) position, the rich air-fuel mixture supply opening 22 at the end portion of the communication passage 21 on the combustion chamber 13 side is blocked by the piston 6. The highly compressed gas intake opening 27 is then blocked by the piston 6, so that the injection of the rich air-fuel mixture into the combustion chamber 13 and charging of the highly compressed gas into the chamber portion 20 are sequentially completed.

The interior of the combustion chamber 13 is further compressed, and at a position just before the top dead center (TDC) position, the spark plug 19 is ignited. Furthermore, the crank chamber 9 is continuously expanded by upward movement of the piston 6, to thus continue the intake operation.

After the piston 6 reaches the top dead center (TDC) position, the air-fuel mixture in the combustion chamber 13 is burned and the interior of the combustion chamber 13 is expanded. The crank chamber 9 is then compressed by downward movement of the piston 6 to compress air in the crank chamber 9.

At the 90° after top dead center (TDC) position (which varies depending on the vertical position of the exhaust control valve 18), the exhaust opening 17 is opened to exhaust combustion gas from the exhaust passage 16.

Furthermore, at about the 122° after top dead center (TDC) position, the scavenging openings 15 are opened by downward movement of the piston 6. As a result, the air (not containing fuel) compressed in the crank chamber 9 flows from the scavenging openings 15 into the combustion chamber 13 through the air supply scavenging passages 14 to push the burnt gas in the combustion chamber 13 toward the exhaust opening 17. Therefore, scavenging including only air is performed. At the same time, fuel is injected from the fuel injection device 26 into the mixing chamber 21*c* to create a rich air-fuel mixture.

At about the 58° after bottom dead center (BDC) position, the scavenging openings 15 are blocked by upward movement of the piston 6 and scavenging due to flow-in of air from the scavenging openings 15 is stopped. At this position, the rotary valve 24 opens the communicating passage 21 and the air-fuel mixture in the mixing chamber 21*c* passes through the communicating passage 21*b*. Furthermore, the communication passage 21*a* on the downstream side of the rotary valve 24 is injected from the rich air-fuel supply opening 22 into the combustion chamber 13. At the same time, air is sucked in the crank chamber 9 from the intake passage 10 through the reed valve 12 by expansion of the interior of the crank chamber 9 by upward movement of the piston 6. In addition, upon injection of the rich air-fuel mixture minimal blowby of the air-fuel mixture occurs.

In the spark ignition type two-cycle internal combustion engine 1, since scavenging only with air is performed at the beginning of the scavenging step, it is possible to prevent blowby, i.e., where the air-fuel mixture passes through the interior of the combustion chamber 13 and is exhausted in the exhaust passage 16. Therefore, fuel consumption is reduced and air pollution due to unburned gas is prevented.

The air-fuel mixture produced by mixing air charged in the chamber portion 20 with fuel injected from the fuel injection device 26 in the mixing chamber 21 c is rich and the rich air-fuel mixture flowing in the combustion chamber 13 has been sufficiently scavenged, since air (not containing fuel) has passed through the air supply scavenging passages 14. The rich air-fuel mixture therefore becomes an air-fuel mixture at a suitable concentration in the combustion chamber 13. Furthermore, the air-fuel mixture thus adjusted in the combustion chamber 13 allows desired combustion, thus attaining a low level of fuel consumption and a high exhaust gas purifying performance.

Furthermore, the height Ha of the rich air-fuel mixture injection opening 22 is set to be smaller than the distance Hb between the outermost side surfaces A and B of the two piston rings 29*a* and 29*b* mounted in the piston. Accordingly, when the two piston rings 29*a* and 29*b* pass by the rich air-fuel mixture injection opening 22, at least one of the piston rigs 29*a* or 29*b* closes the gap between the piston 6 and the cylinder bore 5.

Figure 3:
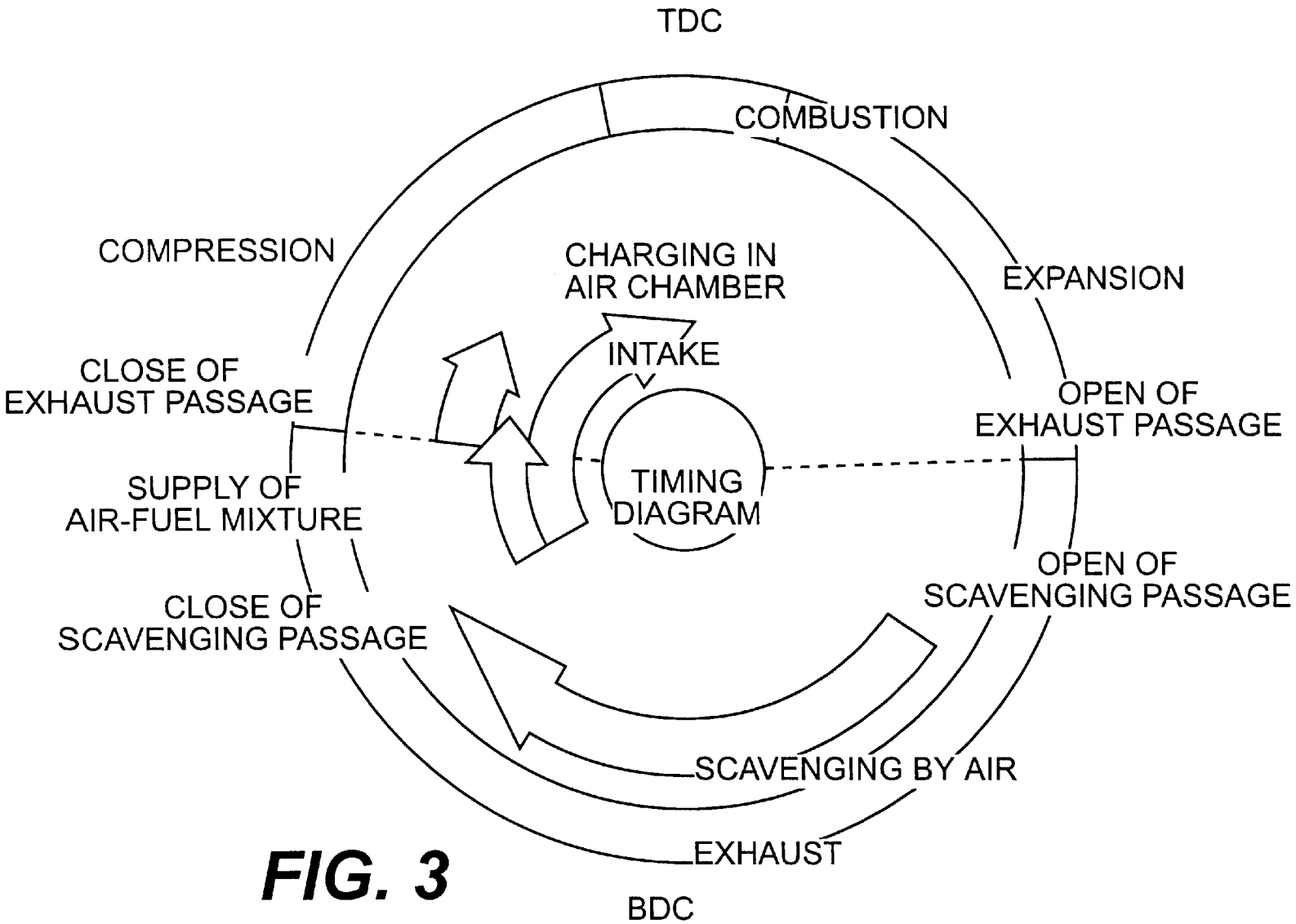
FIG. 3 is diagram illustrating an operational cycle of the embodiment shown in FIG. 1.

As is apparent from FIG. 1 and the above description with reference to FIG. 3, the engine 1 lies in either the final state of the exhaust stroke, the compression stroke, the expansion stroke or the beginning of the exhaust stroke. In such a state, the combustion chamber 13 is filled with an air-fuel mixture or a combustion gas. However, as descried above, since the gap between the piston 6 and the cylinder bore 5 is closed by at least one of the piston rings 29*a* or 29*b*, even in the case where a gap communicating with the combustion chamber 13 or crank chamber 9 is formed between the piston 6 and the rich air-fuel mixture injection opening 22, it is possible to prevent the air-fuel mixture and combustion gas from leaking into the crank chamber 9 through the gap. Therefore, reduction in engine output and seizure of the piston due to local temperature rise is avoided.

The height Hc of the highly compressed gas intake opening 27 for sucking highly compressed gas for forming a rich air-fuel mixture is also set to be smaller than the distance Hb between the outermost side surfaces A of the two piston rings 29*a* and 29*b* mounted in the piston. Accordingly, when the two piston rings 29*a* and 29*b* pass through the highly compressed gas intake opening 27 portion, one of the piston rigs 29*a* or 29*b* closes the gap between the piston 6 and the cylinder bore 5.

As is apparent from FIG. 1 and the above description with reference to FIG. 3, the engine 1 lies in the compression stroke or the expansion stroke. In such a state, the combustion chamber 13 is filled with an air-fuel mixture or a combustion gas. However, as described above, since one of the piston rings 29*a* or 29*b* closes the gap between the piston 6 and the cylinder bore 5, even when a gap communicating between the combustion chamber 13 or the crank chamber 9 is formed between the piston 6 and the highly compressed gas intake opening 27, it is possible to prevent the air-fuel mixture and combustion gas from leaking into the crank chamber 9 through the gap. Therefore, reduction in engine output and seizure of the piston due to local temperature rise is avoided.

Figure 4:
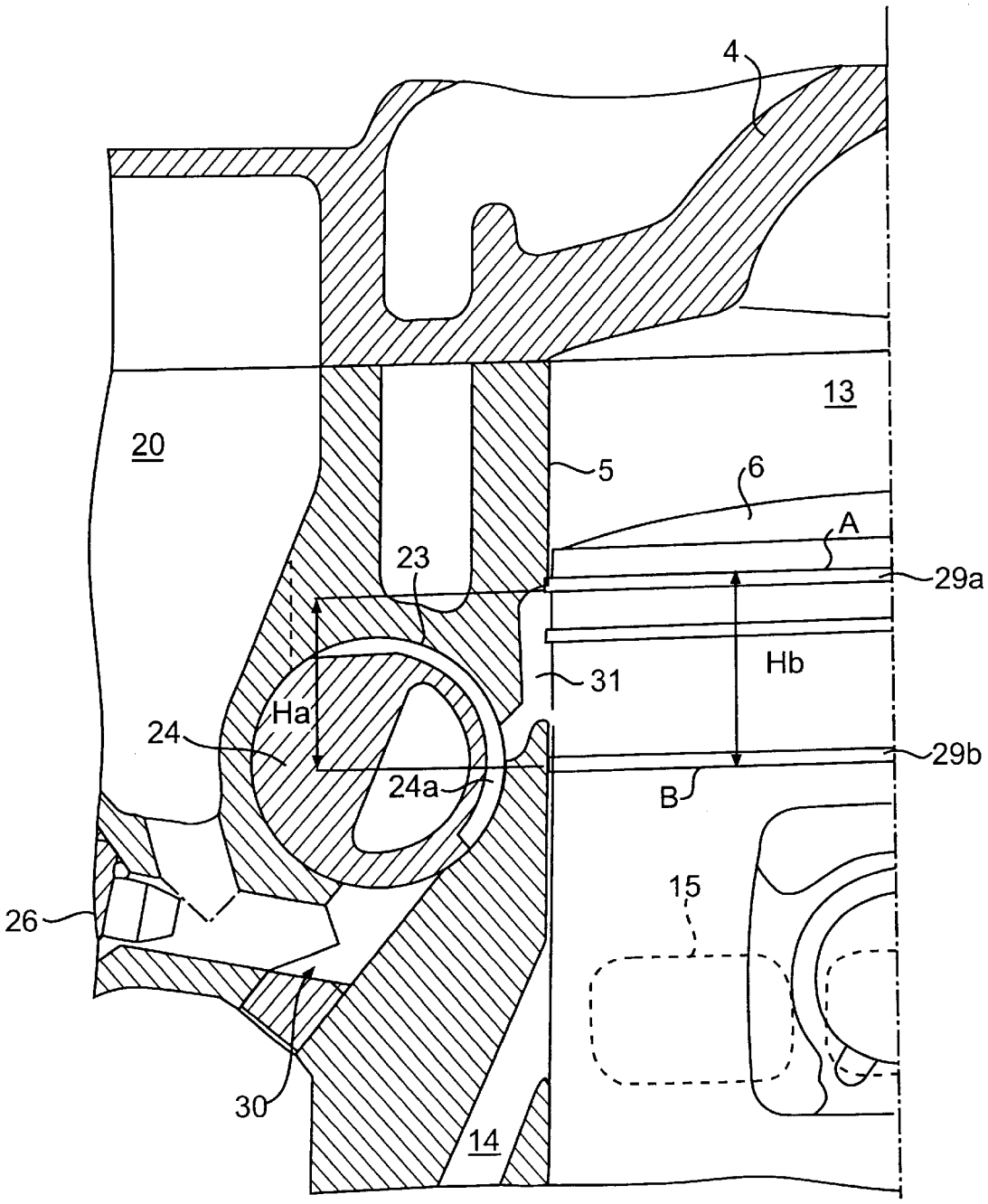
FIG. 4 is a vertical sectional view showing an essential portion of a two-cycle internal combustion engine according to a second embodiment of the present invention.
Figure 5:
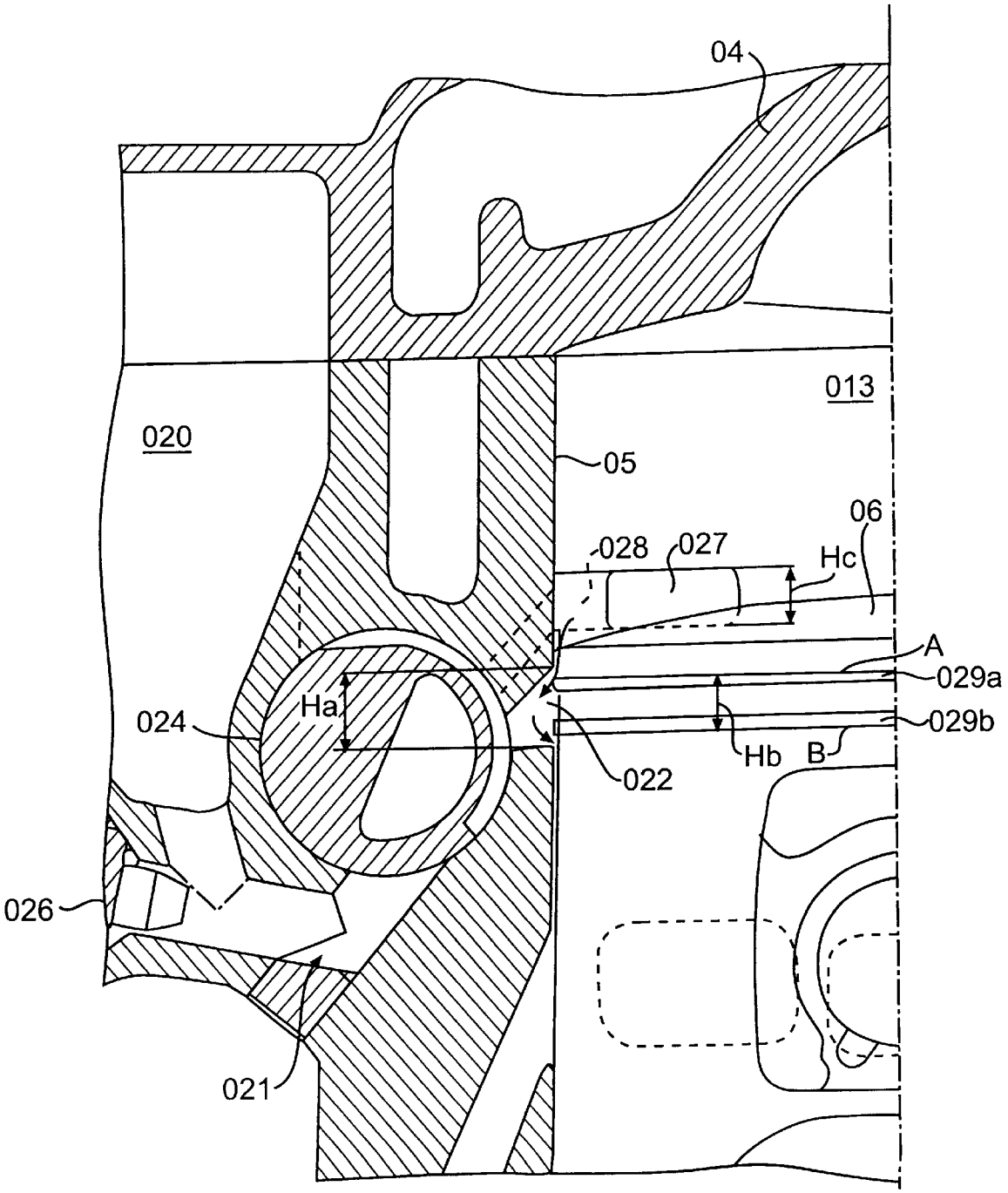
FIG. 5 BACKGROUND ART
FIG. 5 is a view, similar to FIGS. 2 and 4, showing a related art two-cycle internal combustion engine.

A second embodiment of the present invention will be described with reference to FIG. 4.

In this embodiment, the communicating passage 21 for carrying a rich air-fuel mixture and the communicating passage 28 for carrying a highly compressed gas from the combustion chamber 13 to the chamber portion 20 in the first embodiment are a common passage 30 and the opening and closing of the communicating passage 30 is controlled by the rotary valve 24.

Accordingly, both charging of highly compressed gas from the combustion chamber 13 to the chamber portion 20 and supply of a rich air-fuel mixture from the chamber portion 20 side into the combustion chamber 13 are performed through the common passage 30 and a common opening 31 when the communicating passage 30 is opened by the rotary valve 24. A motive force for charging the highly compressed gas or supplying the air-fuel mixture is based on a balance between the pressure in each the chambers.

With regard to the timing for stopping charging of the highly compressed gas from the combustion chamber 13 into the chamber portion 20, the timing for starting injection of the rich air-fuel mixture from the chamber portion 20 side into the combustion chamber 13, and the timing for stopping injection of the air-fuel mixture, the timing is the same as in the first embodiment (see FIG. 3). However, the timing for starting charging of the highly compressed gas from the combustion chamber 13 into the chamber portion 20 is different from the first embodiment. It is equivalent to a period in which the pressure in the combustion chamber 13 is balanced with the pressure in the chamber portion 20 and the supply of the rich air-fuel mixture from the chamber 20 side into the combustion chamber 13 is stopped. This is because the communicating passage 30 is continuously in communication with a specific length of the rotary valve 24 through a peripheral cutout 24*a* between the time that the supply of the rich air-fuel mixture from the chamber portion 20 side into the combustion chamber 13 is begun to the time that charging of the highly compressed gas from the combustion chamber 13 into the chamber portion 20 is stopped.

The opening 31 communicating with the combustion chamber 13 of the communicating passage 30 is enlarged in length vertically and extends toward the combustion chamber 13, so that the cross-section of the opening 31 is larger than that of the midway of the communicating passage 30. This allows the highly compressed gas to easily enter the chamber portion 20. Furthermore, a height Ha of the opening 31 is smaller than the distance Hb between the outermost side surfaces A and B of the two outermost piston rings 29*a* and 29*b* spaced away from each other in the axial direction of the piston 6.

In the second embodiment described above, the configuration of the communicating passage for carrying a rich air-fuel mixture, the configuration of the communicating passage for carrying a highly compressed gas, and the configuration of the control valve 24 are simplified, thereby simplifying manufacturing of the two-cycle internal combustion engine.

In this embodiment, the height Ha of the rich air-fuel mixture injection opening 31, serving as the highly compressed gas intake opening, is smaller than the height Hb between the outermost side surfaces A and B of the two outermost piston rings 29*a* and 29*b*. Accordingly, when the two piston rings 29*a* and 29*b* pass by the opening 31, one of the piston rings 29*a* and 29*b* closes the gap between the piston 6 and the cylinder bore 5.

As a result, as in the first embodiment, even when a gap communicating with the combustion chamber 13 or the crank chamber 9 is formed between the piston 6 and the opening 31, it is possible to prevent the air-fuel mixture or combustion gas from leaking into the crank chamber 9 through the gap. Therefore, reduction in engine output and seizure of the piston due to local temperature rise is avoided.

Although there are two or three piston rings mounted in the piston 6 in the first and second embodiments, there may be more than three piston rings. In this case, the same effect as described above can be obtained when either the axially outer side surface of the uppermost piston ring in the axial direction of the piston and the axially outer side surface of the lowermost piston ring in the axial direction of the piston is considered as a surfaces A and B.

Furthermore, as a third embodiment of the invention, air for forming the rich air-fuel mixture may be taken from the crank chamber 9. Even in this case, the same effect as described above can be obtained by applying the present invention to the rich air-fuel mixture injection opening 22.

What is claimed is:

1. A two-cycle internal combustion engine comprising:

a combustion chamber;

a piston mounted for reciprocation within said combustion chamber, said piston including a plurality of piston rings mounted thereon;

a communicating passage in communication with said combustion chamber, wherein a height of said communicating passage is smaller than a distance between outermost side surfaces of said plurality of piston rings mounted on said piston; and a control valve is disposed in said communicating passage for controlling opening and closing of said communicating passage, wherein a fuel or an air-fuel mixture is supplied to said combustion chamber through said communicating passage.

2. A two-cycle internal combustion engine comprising:

a combustion chamber;

a piston mounted for reciprocation within said combustion chamber, said piston including a plurality of piston rings mounted thereon;

a communicating passage in communication with said combustion chamber, wherein a height of said communicating passage is smaller than a distance between outermost side surfaces of said plurality of piston rings mounted on said piston; and a chamber portion adjacent to said combustion chamber, said communicating passage is for communicating said combustion chamber with said chamber portion.

3. The two-cycle internal combustion engine according to claim 2, further comprising:

a control valve disposed in said communicating passage for controlling opening and closing of said communicating passage, a fuel or an air-fuel mixture is supplied to said combustion chamber through said communicating passage.

4. The two-cycle internal combustion engine according to claim 2, wherein there are two of said piston rings mounted on said piston, and the height of the communicating passage is slightly smaller than the distance between the outermost side surfaces of said two piston rings.

5. The two-cycle internal combustion engine according to claim 2, wherein there are three of said piston rings mounted on said piston, and the height of the communicating passage is slightly smaller than the distance between the outermost side surfaces of the outermost of said three piston rings.

6. The two-cycle internal combustion engine according to claim 2, wherein said height of said communicating passage is larger than a distance between innermost side surfaces of outermost of said plurality of piston rings.

7. A two-cycle internal combustion engine comprising:

a combustion chamber;

a piston mounted for reciprocation within said combustion chamber, said piston including a plurality of piston rings mounted thereon;

a communicating passage in communication with said combustion chamber, wherein a height of said communicating passage is smaller than a distance between outermost side surfaces of said plurality of piston rings mounted on said piston; and said communicating passage is a first communicating passage, said two-cycle internal combustion engine further comprising a second communicating passage for communicating said combustion chamber with said chamber portion and for transferring a highly compressed gas from said combustion chamber to said chamber portion.

8. The two-cycle internal combustion engine according to claim 7, wherein said second communicating passage includes an opening adjacent to said combustion chamber, a height of said opening is slightly smaller than a distance between said outermost side surfaces of said plurality of piston rings and larger than a distance between innermost side surfaces of outermost of said plurality of piston rings.

9. The two-cycle internal combustion engine according to claim 8, wherein there are two of said piston rings mounted on said piston, and the height of said first communicating passage and the height of said opening of said second communicating passage are slightly smaller than the distance between the outermost side surfaces of said two piston rings.

10. The two-cycle internal combustion engine according to claim 8, wherein there are three of said piston rings mounted on said piston, and the height of said first communicating passage and the height of said opening of said second communicating passage are slightly smaller than the distance between the outermost side surfaces of the outermost of said three piston rings.

11. The two-cycle internal combustion engine according to claim 2, wherein said communicating passage is for transferring a highly compressed gas from said combustion chamber to said chamber portion.

12. A two-cycle internal combustion engine comprising:

a combustion chamber;

a piston mounted for reciprocation within said combustion chamber, said piston including a plurality of piston rings mounted thereon;

a chamber portion adjacent to said combustion chamber;

a communicating passage for communicating said combustion chamber with said chamber portion, said communicating passage having a fuel or air-fuel mixture injection opening adjacent to said combustion chamber; and a control valve disposed in said communicating passage for controlling opening and closing of said communicating passage, a fuel or air-fuel mixture is supplied into said combustion chamber through said communicating passage, wherein a height of the fuel or air-fuel mixture injection opening of said communicating passage is slightly smaller than a distance between outermost side surfaces of outermost of said plurality of piston rings mounted in said piston.

13. The two-cycle internal combustion engine according to claim 12, wherein said communicating passage is a first communicating passage, said two-cycle internal combustion engine further comprising a second communicating passage for communicating said combustion chamber with said chamber portion and for transferring a highly compressed gas from said combustion chamber to said chamber portion.

14. The two-cycle internal combustion engine according to claim 13, wherein said second communicating passage includes an opening adjacent to said combustion chamber, a height of said opening is slightly smaller than a distance between said outermost side surfaces of said plurality of piston rings and larger than a distance between innermost side surfaces of outermost of said plurality of piston rings.

15. The two-cycle internal combustion engine according to claim 12, wherein there are two of said piston rings mounted on said piston, and the height of the communicating passage is slightly smaller than the distance between the outermost side surfaces of said two piston rings.

16. The two-cycle internal combustion engine according to claim 12, wherein there are three of said piston rings mounted on said piston, and the height of the communicating passage is slightly smaller than the distance between the outermost side surfaces of the outermost of said three piston rings.

17. A two-cycle internal combustion engine comprising:

a combustion chamber;

a piston mounted for reciprocation within said combustion chamber, said piston including a plurality of piston rings mounted thereon;

a chamber portion adjacent to said combustion chamber;

a first communicating passage for communicating said combustion chamber with said chamber portion;

a control valve disposed in said first communicating passage for controlling opening and closing of said communicating passage, wherein a fuel or air-fuel mixture is supplied into said combustion chamber through said communicating passage; and a second communicating passage for communicating said combustion chamber with said chamber portion, said second communicating passage having an opening adjacent to said combustion chamber, wherein a highly compressed gas in said combustion chamber is transferred into said chamber portion through said opening and said second communicating passage, wherein a height of said opening of said second communicating passage is smaller than a distance between outermost side surfaces of said plurality of piston rings mounted in said piston.

18. The two-cycle internal combustion engine according to claim 17, wherein there are two of said piston rings mounted on said piston, and the height of said opening of said second communicating passage is smaller than the distance between the outermost side surfaces of said two piston rings.

19. The two-cycle internal combustion engine according to claim 17, wherein there are three of said piston rings mounted on said piston, and the height of the opening of said second communicating passage is smaller than the distance between the outermost side surfaces of the outermost of said three piston rings.

* * * * *